US008011968B2

(12) United States Patent
Lai et al.

(10) Patent No.: US 8,011,968 B2
(45) Date of Patent: Sep. 6, 2011

(54) ELECTRICAL CONNECTOR WITH IMPROVED CONTACTS

(75) Inventors: Chin-Te Lai, Tu-Cheng (TW); Li-Bin Wang, Kunshan (CN); Su-Feng Liu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/779,972

(22) Filed: May 14, 2010

(65) Prior Publication Data

US 2010/0291801 A1 Nov. 18, 2010

(30) Foreign Application Priority Data

May 14, 2009 (CN) ..... 200920303151

(51) Int. Cl.
*H01R 24/00* (2011.01)

(52) U.S. Cl. ..... 439/660

(58) Field of Classification Search ..... 439/660, 439/607.48, 607.5
See application file for complete search history.

(56) References Cited

U.S. PATENT DOCUMENTS

| | | | | |
|---|---|---|---|---|
| 7,393,247 | B1 * | 7/2008 | Yu et al. | 439/638 |
| 7,537,488 | B2 * | 5/2009 | Iwakawa | 439/660 |
| 7,559,805 | B1 | 7/2009 | Yi et al. | |
| 7,661,993 | B2 * | 2/2010 | Liu | 439/660 |
| 7,695,318 | B1 * | 4/2010 | Wang et al. | 439/607.01 |
| 2005/0014418 | A1 * | 1/2005 | Ji et al. | 439/660 |
| 2010/0248552 | A1 * | 9/2010 | He et al. | 439/638 |
| 2010/0285696 | A1 * | 11/2010 | Lebrun et al. | 439/660 |
| 2011/0076889 | A1 * | 1/2011 | Rossman et al. | 439/660 |
| 2011/0034080 | A1 * | 2/2011 | Su et al. | 439/607.01 |

* cited by examiner

*Primary Examiner* — Phuong K Dinh
(74) *Attorney, Agent, or Firm* — Wei Te Chung; Andrew C. Cheng; Ming Chieh Chang

(57) ABSTRACT

An electrical connector includes an insulative housing (1) having a chamber (101, 1121); a set of contacts (2, 23) retained in the insulative housing, and having contacting portions (21, 31) exposed to the chamber and tail portions (23, 34), the contacts including a second grounding contact (351) and a third grounding contact (355) perpendicular to the second grounding contact; an electrical means (5) electrically connecting the second grounding contact and the third grounding contact; and a metal shell (4) enclosing the insulative housing (1).

14 Claims, 5 Drawing Sheets

ELECTRICAL CONNECTOR WITH IMPROVED CONTACTS

BACKGROUND OF THE INVENTION

1. Field of the Invention

The present invention relates to an electrical connector, and more particularly to electrical connectors with improved contacts.

2. Description of Related Art

At present, Universal Serial BUS (USB) is a widely used input/output interface adapted for many electronic devices, such as personal computer and related peripherals. In 1994, Intel, HP, IBM, NEC etc. together founded USB-IF to define a spec of USB. Nowadays, USB-IF has published several editions for USB, and transmitting rate of USB has becomes higher and higher. As development of electronic industry, higher transmitting rate of USB based connection accessory is needed.

A USB 3.0 specification over USB 2.0 has been disclosed to be adopted for transmitting high speed data. However, the USB 3.0 receptacle or plug will need more additional contacts for transmitting data, the increased number of the contacts will make the USB 3.0 receptacle soldered to a PCB complicatedly or make the USB 3.0 plug soldered to a cable complicatedly.

Hence, an improved electrical connector with an improved grounding means is desired to overcome the above problems.

BRIEF SUMMARY OF THE INVENTION

According to one aspect of the present invention, an electrical connector comprises an insulative housing defining a chamber; a plurality of contacts retained in the insulative housing, and having contacting portions exposed to the chamber and tail portions, the contacts comprising a second grounding contact and a third grounding contact perpendicular to the second grounding contact; an electrical means electrically connecting the second grounding contact and the third grounding contact; and a metal shell enclosing the insulative housing.

According to another aspect of the present invention, an electrical plug comprises: an insulative housing defining a front face and a receiving cavity recessed backwardly from the front face for receiving a plug, and a pair of slots at two lateral sides of the receiving cavity and communicating with the receiving cavity; a plurality of contacts extending into the receiving cavity for mating with the plug; a metal shell enclosing the insulative housing and comprising a top wall, a pair of side walls extending downwardly from two lateral sides of the top wall, a front wall bending downwardly from front end of the top wall, the front wall defining an inserting hole in accordance with the receiving cavity, the side walls having a pair of engaging arms bending backwardly from respective front sides thereof for being retained into the respective slots and protruding into the receiving cavity for abutting against two sides of the plug; and a grounding means comprising a main plate extending obliquely relative to the front face of the insulative housing and defining an opening in accordance with the receiving cavity, a retaining plate integrally extending from a bottom edge of the main plate and sandwiched between the front wall and the front face of the insulative housing, and a bending plate bending backwardly at an appropriate angle relative to the main plate for abutting against the metal panel. The retaining plate comprises a bight portion connecting to the bottom edge of the main plate for being sandwiched between the front wall and the front face of the insulative housing, a pair of tangs extending from the bight portion and retained in clearances formed between the front wall and the engaging arms.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
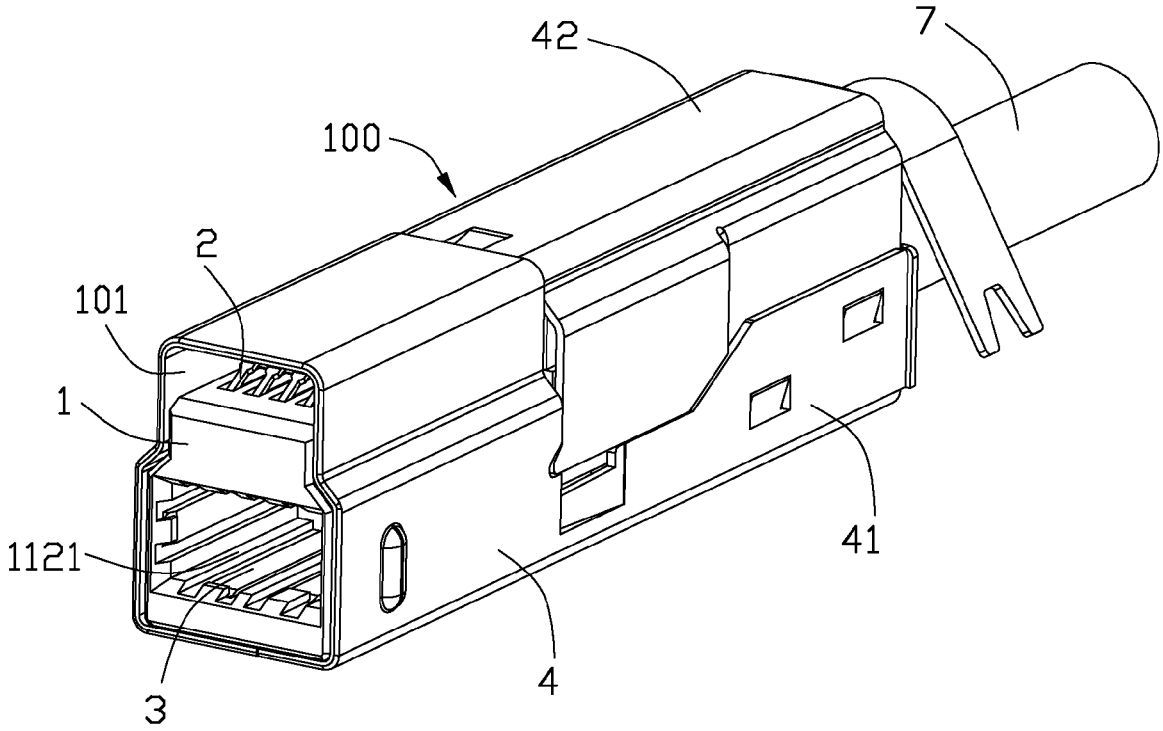
FIG. 1 is a perspective view of an electrical connector according to the present invention.
Figure 2:
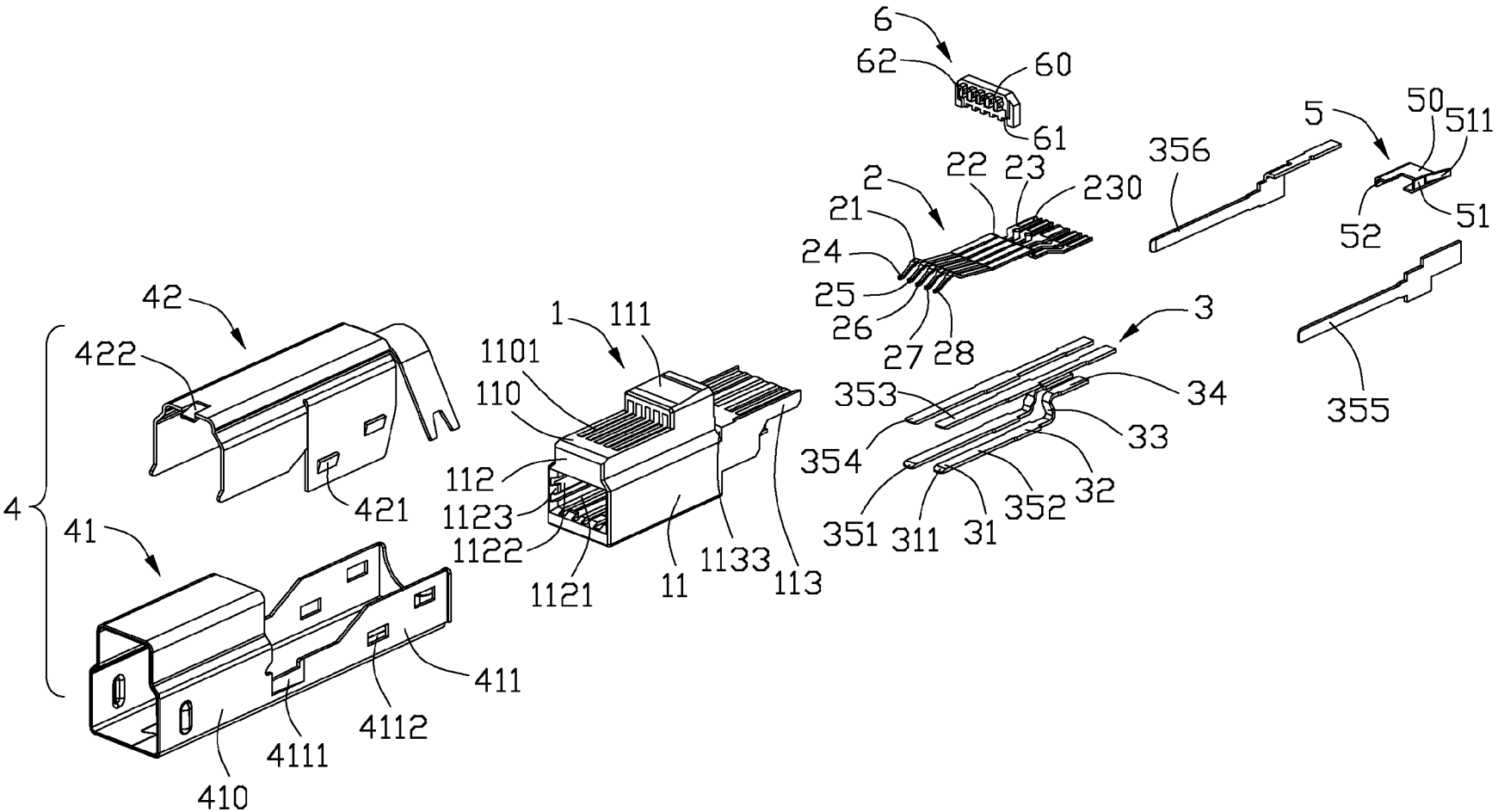
FIG. 2 is an exploded view of the electrical connector shown in FIG. 1.
Figure 3:
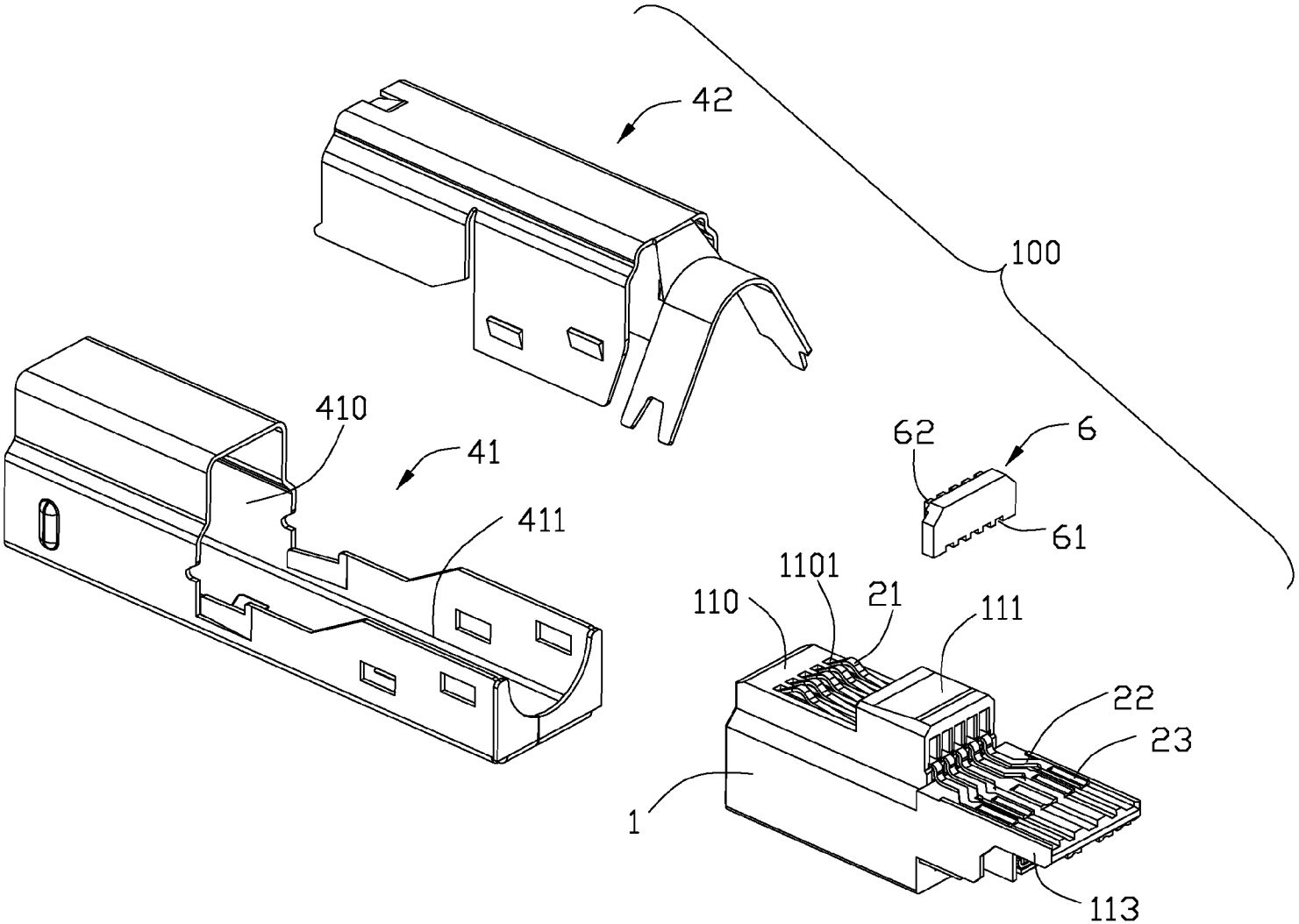
FIG. 3 is a partly exploded view of the electrical connector showing a spacer detached therefrom.
Figure 4:
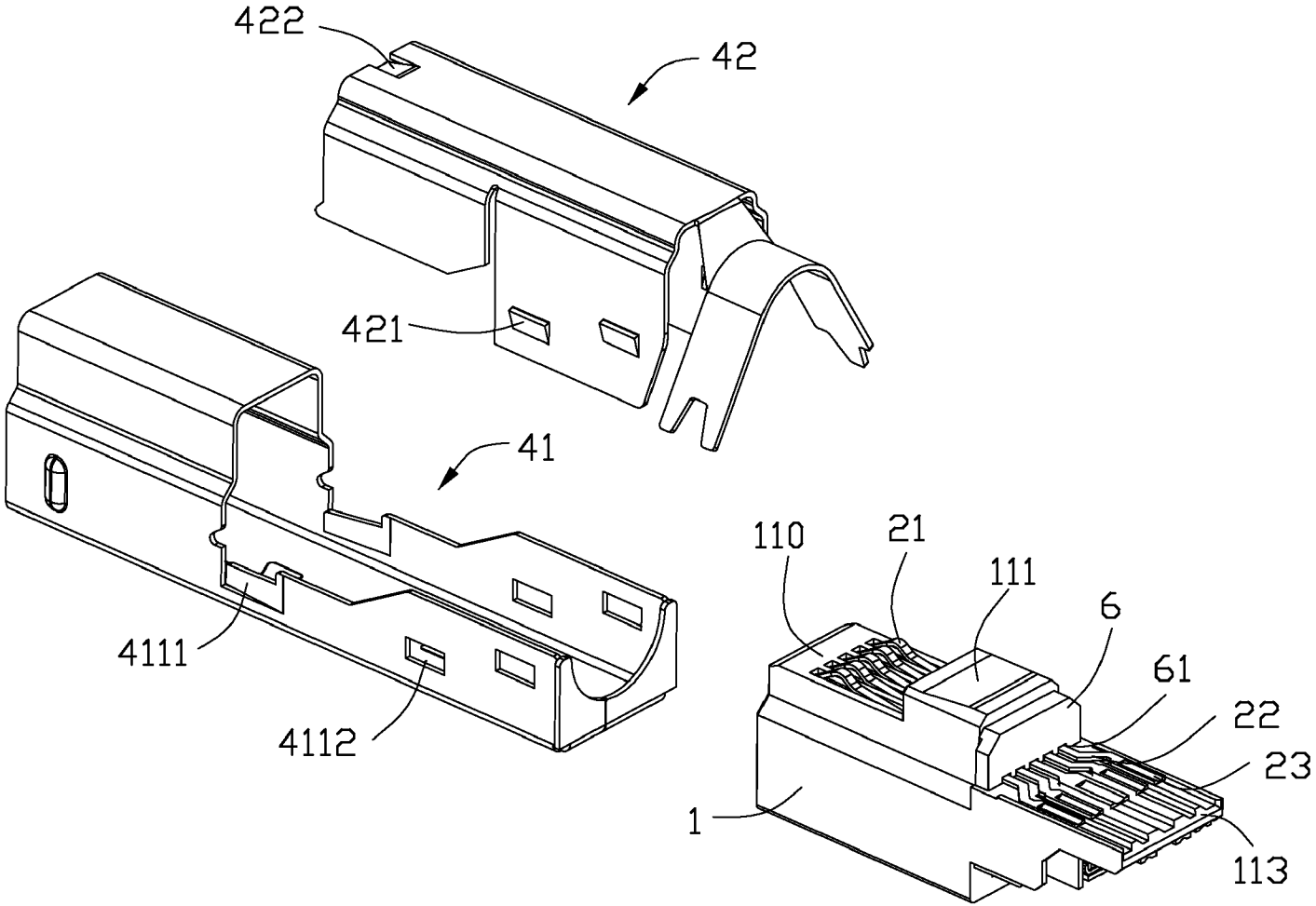
FIG. 4 is a partly exploded view of the electrical connector showing the spacer assembled thereto.
Figure 5:
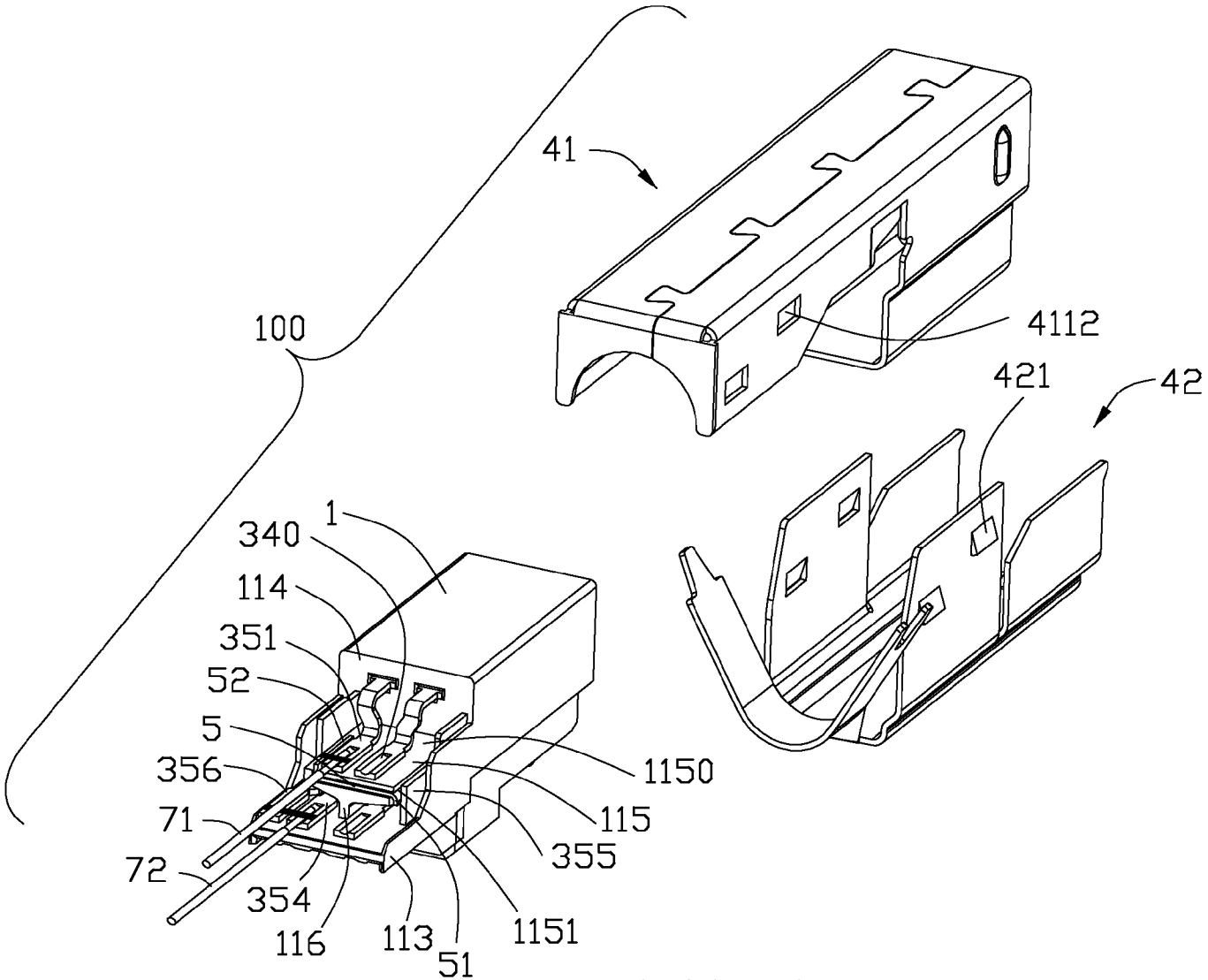
FIG. 5 is similar to FIG. 4, but viewed from another aspect.

Referring to FIGS. 1 and 2, an electrical plug 100 according to the present invention is disclosed. The electrical plug 100 is a B-type USB 3.0 plug. The electrical plug 100 includes an insulative housing 1, a plurality of first and second contacts 2, 3 retained in the insulative housing 1, a spacer 6 assembled to the insulative housing 1 for retaining the first and second contacts 2, 3, a metal shell 4 enclosing the insulative housing 1 for EMI protection, and a plastic case (not shown) surrounding the metal shell 4.

Referring to FIGS. 2-5, the insulative housing 1 is molded of dielectric material such as plastic or the like, and includes a main portion 11 having an upper separate plate 110, a standoff 111 extending upwardly from an upper surface of the separate plate 110, a first and second supporting plates 113, 115 extending backwardly from a rear face 114 of the main portion 11 and spaced apart from each other along a height direction of the insulative housing 1, and a rib 116 connecting the first and second supporting plates 113, 115. A first chamber 101 is formed between the shell 4 and the upper separate plate 110. A second chamber 1121 is recessed backwardly from a front face 112 of the main portion 11. The insulative housing 1 has a plurality of first passageways 1101 communicating with the first chamber 101 and recessed downwardly from the upper surface of the upper separate plate 110 and the first supporting plate 113 and passing through the standoff 111, a plurality of second passageways 1122 communicating with the second chamber 1121 and located on a top side, a bottom side and two lateral sides of the second chamber 1121, and a plurality of blocks 1123 located at front ends of the corresponding second passageways 1122.

The first contacts 2 are retained in the first passageways 1101 and include a first pair of differential contacts 24, 25, a second pair of differential contacts 27, 28, and a first grounding contact 26 located between the first and second pairs of differential contacts 24, 25, 27, 28. Each first contact 2 has a first resilient contacting portion 21 protruding upwardly beyond the upper surface of the upper separate plate 110, a first tail portion 23 retained on the upper surface of the first supporting plate 113 and define a first slot 230 for being soldered to the cable 7 easily, and a first connecting portion 22 connecting the first contacting portion 21 and the first tail portion 23. The first connecting portions 22 horizontal offset toward two lateral sides of the first contacts 2 so as to increase distances among the first tail portions 23.

The second contacts 3 are retained in the second passageways 1122 and include a third pair of differential contacts 352, 353, a second grounding contact 351, a first power contact 354, a second power contact 356, and a third grounding contact 355. The second grounding contact 351, the first power contact 354, and the third pair of differential contacts 352, 353 are adapted for B type USB 2.0 protocol. The third grounding contact 355 and the second power contact 356 are retained in the second passageways 1122 which are located at two lateral sides of the second chamber 1122. Each second contact 3 has a stiff second contacting portion 31 retained in the second passageways 1122 and exposed to the second chamber 1121, a second tail portion 34 defines a second slot 340 for being soldered to the cable 7 easily, and a second connecting portion 32 connecting the second contacting portion 31 and the second tail portion 34. Each second contacting portion 31 has a front distal end 311 positioned by the block 1123 to prevent the distal end 311 from moving forwardly and warped toward the second chamber 1121. The second contacting portions 31 of the second power contact 356 and the third grounding contact 355 are perpendicular to the second contacting portions 31 of the first power contact 354. The second tail portions 34 of the second grounding contact 351 and one of the third pair of differential contacts 352 are retained on a lower surface of the second supporting plate 115. The first power contact 354 and the other one of the third pair of differential contacts 353 are retained on a lower surface of the first supporting plate 113. The second tail portion 34 of the second power contact 356 are retained on the lower surface of the first supporting plate 113 and are parallel to the second tail portion 34 of the second grounding contact 351. The second tail portion 34 of the second power contact 356 is located adjacent to the second tail portion 34 of the first power contact 354. Therefore, the second tail portions 34 of the first power contact 354 and the second power contact 356 could be electrical connected together with soldering tin or others (signed as wide black lines) and be soldered to only one electrical wire 72 of the cable, the soldering times and the number of the cables 7 will be decreased. The second tail portion 34 of the third grounding contact 355 are located on a right side of the second supporting plate 115 and are perpendicular to the second tail portion 34 of the second grounding contact 351.

The electrical plug 100 further comprises a Z-shaped metal bridge 5 having a retaining portion 50 retained in a groove 1151 recessed forwardly from a rear surface of the second supporting plate 115, a first mating portion 51 bending upwardly from one lateral side of the retaining portion 50 and defining a spring tab 511 for contacting with the second tail portion 34 of the third grounding contact 355, a second mating portion 52 bending downwardly from the other lateral side of the retaining portion 50 for contacting with the second tail portion 34 of the second grounding contact 351. In other embodiments, the second mating portion 52 could define a spring tab for contacting with the second tail portion 34 of the second grounding contact 351. The second tail portion 34 of the third grounding contact 355 electrically connect with the second tail portion 34 of the second grounding contact 351 via the metal bridge 5, therefore, the second tail portions 34 of the second grounding contact 351 and the third grounding contact 355 could be soldered to only one electrical wire 71 of the cable 7 to achieve effects of grounding and prevention of static electricity. In other embodiments, the metal bridge 5 could be a PCB defining an electrical path or other electrical means which can realize the electrical connection between the second grounding contact 351 and the third grounding contact 355.

The spacer 6 has a plurality of protrusions 62 extending forwardly from a front face 60 thereof for being retained in the passageways 1101 on the standoff 111.

The metal shell includes a front shell 41 enclosing the insulative housing 1, a back shell 42 attached to the front shell 41 and a back side of the insulative housing 1. The front shell 41 is stamped from a unitary one-piece metal sheet, and comprises a tube portion 410 enclosing the main portion 11 and a drawer portion 411 extending backwardly from the tube portion 410 for latching with the back shell 42. The drawer portion 411 has a pair of resisting tabs 4111 resisting the rear face 114 of the main portion 11. The back shell 42 has a set of protrusions 421 for latching with holes 4112 formed on the drawer portion 411 and a latching tab 422 for latching on the standoff 111.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing defining a chamber;

a plurality of contacts retained in the insulative housing, and having contacting portions exposed to the chamber and tail portions, the contacts comprising a first grounding contact and a second grounding contact perpendicular to the first grounding contact;

an electrical means electrically connecting the first grounding contact and the second grounding contact; and a metal shell enclosing the insulative housing; wherein the electrical means is a metal bridge having a horizontal retaining portion retained in the insulative housing, a first mating portion bending upwardly from one lateral side of the retaining portion for contacting with the second grounding contact, and a second mating portion bending downwardly from the other lateral side of the retaining portion for contacting with the first grounding contact; wherein the first mating portion defines a tab protruding outwardly for contacting with the second grounding contact.

2. The electrical connector according to claim 1, wherein the contacts comprise a first power contact, and a second power contact electrically connecting with the first power contact.

3. The electrical connector according to claim 2, wherein the contacting portion of the first power contact is perpendicular to the contacting portion of the second power contact and parallel to the contacting portion of the first grounding contact.

4. The electrical connector according to claim 2, wherein the tail portions of the first and second power contacts are coplanar in a horizontal plane and are parallel to the tail portion of the first grounding contact, the space between the tail portions of the first and second power contacts are narrower than the space between the contacting portions of the first and second power contacts.

5. The electrical connector according to claim 2, wherein the contacts comprise a pair of differential contacts parallel to each other, the contacting portions of the first grounding contact, the first power contact, and the pair of differential contacts are located between the contacting portions of the second power contact and the second grounding contact.

6. The electrical connector according to claim 5, wherein the chamber has a first chamber and a second chamber separated by a separate plate, the contacting portions of the first grounding contact, the second grounding contact, the pair of differential contacts, and the first and second power contacts are exposed to the second chamber, the contacts further comprise two pairs of differential contacts and a third grounding contact located between the two pairs of differential contacts, the contacting portions of the two pairs of differential contacts and the third grounding contact are exposed to the first chamber.

7. An electrical plug comprising:

an insulative housing defining a first chamber recessed backwardly from a front face thereof;

a metal shell enclosing the insulative housing to form a second chamber restricted by the metal shell and the insulative housing under a condition that the second chamber is located above the first chamber and is narrower than the first chamber;

a plurality of first contacts having elastic first contacting portions extending into the second chamber and first tail portions for being electrically connecting to electrical wires of a cable;

a plurality of second contacts having stiff second contacting portions extending into the first chamber and second tail portions for being electrically connecting to other electrical wires of the cable, the second contacts comprising a first grounding contact and a second grounding contact, the second contacting portion of the first grounding contact being located at a bottom side of the first chamber, the second contacting portion of the second grounding contact being located at a lateral side of the first chamber and being perpendicular to the second contacting portion of the first grounding contact; wherein the second tail portions of the first and second grounding contacts are electrically connected with each other via an electrical means and are connected with only one electrical wire to achieve effects of grounding; wherein the insulative housing has a first supporting plate extending backwardly therefrom and defining an upper surface for supporting the first tail portions, and a second supporting plate parallel to the first supporting plate and defining a lower surface for supporting the second tail portion of the first grounding contact, the second tail portion of the second grounding contact is located at a lateral side of the second supporting plate; wherein the electrical means is a metal bridge having a horizontal retaining portion retained in the second supporting plate, a first mating portion bending upwardly from one lateral side of the retaining portion for contacting with the second tail portion of the second grounding contact, and a second mating portion bending downwardly from the other lateral side of the retaining portion for contacting with the second tail portion of the first grounding contact, the first mating portion is located between the second supporting plate and the second tail portion of the second grounding contact.

8. The electrical plug according to claim 7, wherein the second contacts comprise a first power contact, and a second power contact electrically connecting with the first power contact, the second contacting portion of the first power contact is located at an upper side of the first chamber, the second contacting portion of the second power contact is located at the other lateral side of the first chamber and is perpendicular to the second contacting portion of the first power contact.

9. The electrical plug according to claim 8, wherein the second tail portions of the first and second power contacts are supported on a lower surface of the first supporting plate and are parallel to the second tail portions of the first grounding contact, the space between the second tail portions of the first and second power contacts are narrower than the space between the contacting portions of the first and second power contacts.

10. The electrical plug according to claim 9, wherein the second tail portions of the first and second power contacts are soldered together via soldering tin and are connected with only one electrical wire.

11. The electrical plug according to claim 10, wherein the second contacts comprise a pair of differential contacts parallel to each other, one of the second contacting portions of the pair of differential contacts is supported on the lower surface of the second supporting plate, the other one of the second contacting portions of the pair of differential contacts is supported on the lower surface of the first supporting plate.

12. An electrical connector comprising:

an insulative housing defining a mating cavity defined between two opposite lateral interior faces of the housing, and a mating tongue extending forwardly in said mating cavity under condition that two opposite lateral sides confront said two opposite lateral interior faces;

a plurality of first contacts disposed in the housing with first contacting sections exposed on the mating tongue and with first soldering sections exposed on a rear side of the housing;

a pair of second contacts disposed in the housing with second contacting sections exposed on said two opposite lateral interior faces, respectively, and with second soldering sections exposed on the rear side of the housing; wherein a shorting device connects a selected one of the second soldering sections to a selected one of said first soldering sections; wherein the shorting device is a metal bridge having a horizontal retaining portion retained in the insulative housing, a first mating portion bending in one vertical direction from one lateral side of the retaining portion for contacting with the selected second soldering section, and a second mating portion bending in an opposite vertical direction from the other lateral side of the retaining portion for contacting with the selected first soldering section; wherein the first mating portion defines a tab protruding laterally for contacting with the selected second soldering section.

13. The electrical connector as claimed in claim 12, wherein said second contacts extend vertically while said first contacts extend horizontally.

14. The electrical connector as claimed in claim 12, wherein said shorting device essentially extends in a transverse direction with a distance similar to a dimension of said mating tongue in said transverse direction to contact both said selected first soldering section and said selected second soldering section.

* * * * *